United States Patent [19]

Kindig et al.

[11] 4,119,410

[45] Oct. 10, 1978

[54] PROCESS FOR IMPROVING COAL

[75] Inventors: James K. Kindig, Arvada; Ronald L. Turner, Golden, both of Colo.

[73] Assignee: Hazen Research, Inc., Golden, Colo.

[21] Appl. No.: 764,390

[22] Filed: Jan. 31, 1977

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 3,938,966 | 2/1976 | Kindig et al. | 44/1 R |
| 4,052,170 | 10/1977 | Yan | 44/1 R |

*Primary Examiner*—Carl Dees

*Attorney, Agent, or Firm*—Sheridan, Ross, Fields & McIntosh

[57] ABSTRACT

In a process for improving coal containing elemental sulfur wherein the coal is treated with a metal containing compound in order to enhance the magnetic susceptibility of various impurities contained within the coal thereby permitting their removal by magnetic separation, the improvement comprising removing at least a portion of the elemental sulfur prior to performing the magnetic susceptibility enhancement treatment.

49 Claims, No Drawings

PROCESS FOR IMPROVING COAL

BACKGROUND OF THE INVENTION

1. Field of the Invention

The process of the present invention relates to the improvement of the properties of coal, and is classified generally in the class relating to fuels and igniting devices.

2. The Prior Art

With the present world-wide emphasis on the energy crisis and the rapidly diminishing sources of oil, increased attention by both government and private organizations is being given to coal as a source of energy, especially for the generation of electricity. This country has vast resources of coal for development as other sources of energy diminish.

Depending upon their origin, coals contain varying amounts of iron disulfide (iron disulfide is hereinafter referred to as pyrite whether crystallized as pyrite or marcasite) from which sulfur dioxide is formed as a combustion product when coal is burned. This is a tremendous disadvantage to the use of coal as an energy source, particularly in view of the current emphasis on pollution controls as illustrated by present federal emission control standards for sulfur dioxide. Illustrating the enormity of the sulfur dioxide emission problem is the fact that large transportation expenses are incurred by coal users in transporting Western and European coal of relatively low sulfur content long distances to supplant available high sulfur-containing coals in order to comply with sulfur dioxide emission standards. At this time there are no effective means available which are commercially feasible for absorbing the large amounts of sulfur dioxide emitted by the combustion of coal to produce heat and electricity. One solution to the problem is to separate the sulfur-bearing pyrite from the coal before it is burned.

Coals also contain, depending upon their origin, various amounts and kinds of minerals which form ash when the coal is burned. The ash also is a disadvantage to the use of coal as an energy source, since it contributes no energy value during combustion. The ash causes a dilution of the calorific value of the coal, and causes a waste disposal problem and a potential air pollution problem.

The problem of separating pyrite and/or other impurities from raw coal is not new and a number of methods have been extensively tested over the years. Among these are methods which employ the difference in specific gravity between coal particles and the impurity particles or differences in their surface, electrostatic, chemical, or magnetic properties. For various reasons difficulties are encountered in making an efficient separation of pyrite or other impurities from coal which has been ground fine enough to substantially liberate impurity particles from coal particles. In water systems this difficulty is related to the slow settling rate of fine particles, and in air systems to the large difference in specific gravity between air and the particles. However, for magnetic separations the magnetic attraction force acting on small magnetic particles is many times greater than the opposing force, which is usually a hydraulic drag and/or gravity force.

For the separation of pyrite or other impurities from raw coal the success of a magnetic process is dependent upon some effective treatment process for selectively enhancing the magnetic susceptibility of the pyrite or other impurity. Coal particles alone are slightly diamagnetic while pyrite and many other mineral impurities are weakly paramagnetic; however, their paramagnetism has not been sufficient to economically effect a separation from coal. However, effective beneficiation of coals can be made if the magnetic susceptibility of pyrite or other impurities is increased. For pyrite it has been estimated that a sufficient increase in susceptibility can be achieved by converting less than 0.1 percent of pyrite in pyritic coal into ferromagnetic compounds of iron ("Magnetic Separation of Pyrite from Coals," Bureau of Mines Report of Investigations 7181, p.1).

In discussing the use of heat to enhance the paramagnetism of pyrite it is stated in the above report (p.1) that ferromagnetic compounds of iron are not formed in significant quantities at temperatures below 400° C., and that such conversion occurs in sufficient quantities to effect beneficiation only at temperatures greater than 500° C. As this is above the decomposition temperature of coal, the use of heat to enhance the magnetic susceptibility of impurities does not appear feasible. Further, other methods for enhancing the paramagnetism of pyrite to permit its separation from coal have not been encouraging.

U.S. Pat. No. 3,938,966 discloses a process for improving coal wherein the raw coal is reacted with substantially undecomposed iron carbonyl which alters the magnetic susceptibility of certain impurity components contained in the raw coal, thereby permitting their removal by low-intensity magnetic separators. This process represents a noteworthy advance in the art, as treating coal in accordance with this process may substantially remove impurities such as pyrite, a primary contributor to sulfur dioxide pollution problems. The process of this patent, however, does not appear to possess universal applicability with an equal degree of success in that while many coals are substantially enhanced by this treatment, certain other coals are not as receptive. It has been discovered by the inventors of the present application that pretreating coal to remove at least a portion of elemental sulfur present under various conditions as hereinafter presented substantially enhances the effectiveness of the process of this patent. The process of the present invention therefore constitutes, in part, an improvement of the process described in U.S. Pat. No. 3,938,966, in accordance with the discussion presented hereinafter.

SUMMARY OF THE INVENTION

The process of the present invention entails improving coal containing elemental sulfur and various impurities by initially removing at least a portion of the elemental sulfur, followed by treating the coal with a metal containing compound under conditions such as to enhance the magnetic susceptibility of one or more impurities contained in the raw coal, thereby permitting the removal of these impurities by magnetic means. The pretreatment for removing elemental sulfur may be performed by any suitable means, including, for example, heat treatment, steam treatment, solvent extraction, and chemical reaction.

DESCRIPTION OF THE PREFERRED EMBODIMENT

The process of the present invention can be applied to coals of universal origin, as long as the coal contains one or more impurities receptive to the metal containing compound treatment, and contains sufficient elemental sulfur such that the sulfur interferes with the interreaction of the metal containing compound and the coal.

Generally, the elemental sulfur concentration in raw coal is at least about 10 parts per million, and often this concentration exceeds several hundred parts per million.

Concentrations of elemental sulfur in excess of 10 parts per million are such as to hinder the magnetic susceptibility enhancement reaction. Higher concentrations of elemental sulfur present greater hindrances. It is therefore to be understood that any removal of elemental sulfur prior to performing the magnetic susceptibility enhancement treatment improves this treatment. Preferably the concentration of elemental sulfur following treatment for its removal will be less than about 200 parts per million, more preferably less than about 50 parts per million, and most preferably less than about 10 parts per million, based on the total weight of the raw coal being treated.

Essentially any process for removing elemental sulfur from raw coal can be utilized as the pretreatment means, and examples of suitable processes include heat treatment, steam treatment, solvent extraction and chemical reaction.

The heat pretreatment essentially comprises heating the coal in order to remove elemental sulfur, thereby rendering the coal and impurities more receptive to the magnetic enhancement reaction. The temperature and time of heating are interrelated, and essentially higher temperatures require less time. It is essentially preferred that the temperature and time be selected in accordance with the following equation:

$$D \geqq K\left(\frac{50}{T-90}\right)^3$$

wherein D is time in hours and T is temperature in degrees Celsius, and wherein K is preferably at least about 0.5, more preferably at least about 5, and most preferably at least about 25. The equation is not accurate with respect to temperatures less than about 95° C. Some improvement may be realized at temperatures below 95° C., but the time requirement would be inordinate. Under circumstances when the temperature exceeds the combustion temperature of coal the time must be very short in order to prevent combustion, and preferably not substantially exceeding the value of the equation. Additionally, other precautions known to the art should be complied with.

While operating within the above time-temperature relationship, it is generally preferred that the pretreatment essentially comprise heating the coal to a temperature of at least about 100° C., and more preferably to a temperature of at least about 150° C., and most preferably to a temperature of at least about 170° C. This heat pretreatment is preferably for at least about 1 hour, and more preferably for at least about 2 hours, with respect to temperatures less than the coal combustion temperature.

The heat pretreatment step may be conducted in the presence of one or more gaseous additives, and this is preferable under many circumstances. Examples of suitable gaseous additives include nitrogen, steam, carbon monoxide, carbon dioxide, ammonia, methane, air, ethane, propane, butane, and other hydrocarbon compounds in the gaseous state at the pretreatment temperature. Some of the additives, under certain circumstances, serve as chemical reactants in removing elemental sulfur.

When these additives are employed, it is preferable that they be employed in an amount of at least 2, more preferably at least about 12, and most preferably at least about 120 cubic meters per hour per metric ton of coal being processed.

A particularly preferred additive is steam. Heat pretreatment with steam is preferably conducted within a temperature range of from about 100° C. to about 300° C., more preferably from about 150° C. to about 250° C., and most preferably from about 175° C. to about 225° C. Preferably the pretreatment should be conducted for at least about 0.25 hours, more preferably for at least about 0.5 hours, and most preferably for at least 1 hour. The amount of water preferably ranges from about 2% to about 50%, more preferably from about 5% to about 30%, and most preferably from about 10% to about 25%, based on the weight of the coal being treated.

It is generally preferred to maintain the heat pretreatment temperature at least slightly above the temperature of the magnetic enhancement reaction. This is not an imperative requirement; however, improved results are generally accomplished. The pretreating by heating the coal volatilizes the elemental sulfur. If the magnetic enhancement reaction is conducted at a temperature in excess of the pretreatment temperature, it is possible that additional volatile components could somewhat detrimentally affect the magnetic enhancement reaction.

One particularly preferred technique for performing the heat pretreatment process embodiment of the invention is to conduct the process while the coal is in a fluidized state. Conventional fluidized bed apparati and processes are suitable. This fluidized treatment facilitates thorough pretreatment of all of the coal.

Alternatively, the coal can be pretreated with a solvent or a combination of solvents to effect elemental sulfur removal. Examples of suitable solvents include carbon tetrachloride, toluene, acetone, ethyl alcohol, methyl alcohol, ether, liquid ammonia, and other compounds suitable to dissolve elemental sulfur. Preferred solvents include carbon tetrachloride, petroleum ether and hot toluene followed by a warm acetone rinse.

The amount of a particular solvent used will be dependent on the degree of solubility the elemental sulfur exhibits in the solvent at the treatment temperature. Generally, it is preferable that the solvent be employed in an amount of at least about 500, more preferably at least about 1,000, and most preferably at least about 2,000 milliliters per kilogram of coal.

The elemental sulfur removal step need not be immediately followed by the magnetic enhancement reaction. Hence, the coal may be permitted to be stored for an indefinite period of time prior to conducting the magnetic susceptibility enhancement reaction.

The basic process employs a metal treatment in order to enhance the magnetic susceptibility of an impurity. By selectively enhancing this property of the impurity, while not substantially affecting the coal itself, a magnetic separation may be conventionally accomplished to remove the impurity from the coal. The coal is therefore left in a more pure state, rendering it more suitable for combustion.

"Enhancing the magnetic susceptibility" of a particle or an impurity as used herein is intended to be defined in accordance with the following discussion. Every compound of any type has a specifically defined magnetic susceptibility, which refers to the overall attraction of the compound to a magnetic force. An alteration of the surface characteristics will alter the magnetic susceptibility. The metal treatment of the basic process alters the surface characteristics of an impurity in order to enhance the magnetic susceptibility of the impurity. It is to be understood that the magnetic susceptibility of the impurity is not actually changed, but the particle itself is changed, at least at its surface, resulting in a particle possessing a greater magnetic susceptibility than the original impurity. For convenience of discussion, this alteration is termed herein as "enhancing the magnetic susceptibility" of the particle or impurity itself.

The impurities with which the process of the present invention may be utilized include those impurities which react with one or more of the metal compounds hereinafter described to form a product possessing an enhanced magnetic susceptibility. Examples of such impurities include pyrite; ash-forming minerals, such as clays and shales; and various sulfates, for example, calcium sulfate and iron sulfate. For purposes of illustration the discussion hereinafter often refers to pyrite, but it is to be understood that other suitable impurities may be affected in similar fashion.

Numerous metal containing compounds are suitable to impart this magnetic susceptibility. A number of different mechanisms are believed to be involved in what is termed herein as the magnetic susceptibility enhancement "treatment" and/or "reaction," depending upon the metal containing compound or compounds and the reaction conditions employed. Some metal containing compounds affect the pyrite by combining with some of the pyrite sulfur to yield an iron sulfide more magnetic than pyrite. The following reaction exemplifies this mechanism:

$$6M + 7FeS_2 \rightarrow Fe_7S_8 + 6MS$$

Similarly, ash components, such as $Fe_2O_3$, may react with a metal to form a more strongly magnetic compound, as for example, in accordance with the following reaction:

$$M + 3Fe_2O_3 \rightarrow MO + 2Fe_3O_4$$

In similar fashion, U.S. Pat. No. 3,938,966 and the reaction mechanisms illustrated therein with respect to pyrite and iron pentacarbonyl present viable techniques for enhancing the magnetic susceptibilities of impurities.

Other mechanisms undoubtedly also contribute to the enhancing of the magnetic susceptibility, and again this is principally determined by the particular metal containing compound or compounds employed and the reaction conditions. It is to be understood that in view of the disclosures herein presented, the selection of a given metal compound, along with the most desirable reaction conditions to be employed with the given compound, cannot be itemized for each and every compound due to the number of variables involved. However, the proper selection will be apparent to one skilled in the art with but a minimal amount of experimentation, and it is sufficient to note that the improvement of the invention herein set forth relates to all of these compounds.

Many organic iron containing compounds possess the capability of enhancing the magnetic susceptibility of coal impurities, as long as the compound is adaptable so as to bring the iron in the compound into contact with the impurity under conditions such as to cause an alteration of at least a portion of the surface of the impurity. Organic iron containing compounds capable of exerting sufficient vapor pressure (with iron as a component in the vapor) so as to bring the iron into contact with the impurity at the reaction temperature are suitable, as well as other organic iron containing compounds which can be dissolved and/or "dusted" and brought into contact with the impurity.

Preferred compounds within the vapor pressure group are those which exert a vapor pressure with iron as a component in the vapor of at least about 10 millimeters of mercury, more preferably at least about 25 millimeters of mercury, and most preferably at least about 50 millimeters of mercury at the reaction temperature. Examples of groupings which fall within this vapor pressure definition include ferrocene and its derivatives and $\beta$-diketone compounds of iron. Specific examples include ferrocene, dimethyl ferrocenedioate, 1,1'-ferrocenedicarboxylic acid, ferric acetylacetonate, and ferrous acetylacetonate.

Other organic compounds which may be utilized to enhance the magnetic susceptibility include those which may be dissolved and brought into contact with the impurities. These compounds must have sufficient solubility so as to provide sufficient metal to contact the surface of the impurity. Preferably the solubility is at least about 10 grams per liter, and most preferably at least about 50 grams per liter at the injection temperature. The solvent must, of course, possess the capability of dissolving the organic compounds within the above set forth concentrations, and preferably not create side reaction problems tending to detract from the effectiveness of the process. Suitable solvents include, for example, acetone, petroleum ether, naphtha, hexane, and benzene. This is, of course, dependent upon the particular metal compound being employed.

A grouping which falls within this solution definition includes the carboxylic acid salts of iron; and specific examples include iron octoate, iron naphthenate and iron stearate.

Various inorganic compounds are also capable of producing an enhanced magnetic susceptibility. Preferred inorganic compounds include metal carbonyls, including, for example, iron, nickel, cobalt, molybdenum, tungsten, and chromium carbonyls and derivatives of these compounds. Iron carbonyl is a preferred carbonyl for imparting this magnetic susceptibility, particularly iron pentacarbonyl, iron dodecacarbonyl, and iron nonacarbonyl.

The most preferred metal containing compound capable of enhancing the magnetic susceptibility is iron pentacarbonyl. The process is applied by contacting the raw coal which is liberated from pyrite or other impurities with iron carbonyl under conditions such that there is an insufficient dissociation of carbonyl into metal and carbon monoxide to cause substantial deposition of metal on the coal particles. These conditions are determined by the temperature, the type of carbonyl, pressure, gas composition, etc. Ordinarily, the carbonyl gas is heated to a temperature just below its decomposition temperature under the reaction conditions. Various types of available equipment can be used for contacting the iron carbonyl and coal, such as, a rotating kiln used as the reaction vessel with iron carbonyl vapors carried into contact with the tumbling contents of the kiln by a gas such as nitrogen.

When carbonyl is used as the magnetic susceptibility enhancement reactant, the process must be carried out at a temperature below the temperature of major decomposition of the carbonyl under the reaction conditions so that there is opportunity for the iron of the carbonyl to chemically react with the impurity particles. If the temperature is allowed to rise above the decomposition temperature, the selectivity of the process of enhancing the magnetic susceptibility of one or more impurities without affecting the coal is impaired.

Most preferably the iron pentacarbonyl treatment is performed by contacting the coal with the carbonyl for a time of from about one-half to about four hours at a temperature of from about 150° C. to about 200° C. and a carbonyl concentration of from about 2 to about 16 kilograms per metric ton of coal.

For efficient separations of pyrite from coal, the coal should be crushed to such fineness that pyrite particles are free, or nearly free, from the coal particles. The required fineness depends upon the size distribution of the pyrite in the coal. A thorough treatment of the subject for power plant coals is given in the article entitled "Pyrite Size Distribution and Coal-Pyrite Particle Association in Steam Coals," Bureau of Mines Report of Investigation 7231. The requirement for pyrite liberation applies to all types of physical separations and so is not a disadvantage of this invention. Additionally, present technology for coal-fired power plants generally requires pulverizing the coal to 60–90 percent minus 200 mesh before burning.

EXAMPLES

In each of the examples, the coal sample was separated in a magnetic separator following the described treatment to give a non-magnetic clean coal fraction and a magnetic refuse fraction. The analytical procedure used to determine elemental sulfur was adapted from the method of Bartlett and Skoog, Colorimetric Determination of Elemental Sulfur in Hydrocarbons, Analytical Chemistry, Volume 26, Number 6, June, 1954.

EXAMPLE 1

Pittsburgh coal containing 25 parts per million elemental sulfur, 17.9 weight percent ash and 1.67 weight percent pyritic sulfur was sized to 14 mesh × 0 and treated with 8 kilograms per metric ton of iron pentacarbonyl at a temperature of about 190°–195° C. for 60 minutes. A magnetic separation was performed following the carbonyl treatment. Run 1 was not initially treated for elemental sulfur removal, and Runs 2–5 were treated by the processes described to remove substantially all of the elemental sulfur prior to the carbonyl reaction. Table 1 provides for each of these Runs the clean coal yield based on weight percent of the raw coal feed, and the clean coal weight percentage of ash and pyritic sulfur.

Table 1

| Run No. | Sulfur Removal Technique | S° (ppm) | Clean Coal Analysis Yield Wt. % | Ash, % | Pyritic Sulfur, % |
|---|---|---|---|---|---|
| 1 | None | 25 | 84.6 | 10.8 | 1.09 |
| 2 | Sulfur removed with toluene & acetone | <1 | 84.0 | 9.3 | 0.90 |
| 3 | Sulfur removed with petroleum ether | <1 | 85.9 | 9.4 | 0.85 |
| 4 | Sulfur removed with steam, 95 kg/metric ton, 190–195° C | <1 | 84.0 | 9.0 | 0.83 |
| 5 | Sulfur removed with steam, 95 kg/metric ton, 250–255° C | <1 | 86.5 | 10.0 | 0.93 |

EXAMPLE 2

A Lower Freeport bituminous coal from Pennsylvania. containing 156 parts per million elemental sulfur was sized to a minus 14-mesh. Two samples were treated with 2 kilograms per metric ton iron pentacarbonyl at a temperature of about 190°–195° C. Sample 1 was not pretreated for elemental sulfur removal, while Sample 2 was treated with hot toluene and rinsed with warm acetone prior to the carbonyl treatment. The comparative results are presented in Table 2.

Table 2

| Sample Number | Feed Coal Ash (Wt.%) | Feed Coal Pyritic S (Wt.%) | S° (ppm) | Clean Coal Yield (Wt.%) | Clean Coal Ash (Wt.%) | Clean Coal Pyritic S (Wt.%) |
|---|---|---|---|---|---|---|
| 1 | 33.0 | 2.19 | 156 | 86.8 | 28.5 | 2.44 |
| 2 | 33.0 | 2.19 | <1 | 79.5 | 20.4 | 1.52 |

EXAMPLE 3

For each of the runs presented in Table 3, 75 grams of raw coal, a lower Freeport bituminous coal from Pennsylvania, was sized to 14 mesh by zero and treated for 60 minutes with steam at 200° C. at a rate of 0.46 grams per minute. The initial elemental sulfur concentration was 178 parts per million, and following the steam treatments the concentration in each of the runs was less than 1 part per million. In each of the runs the steam was injected with the designated additive gases set forth in Table 3. The carbonyl treatment for all tests was conducted at a temperature of 170° C. for one hour with 16 kilograms of iron pentacarbonyl per metric ton of coal.

EXAMPLE 4

An Illinois coal containing 105 parts per million elemental sulfur was sized to 14 × 150-mesh. Three samples were treated with 7.5 kilograms per metric ton iron pentacarbonyl at a temperature of about 175°–195° C. for 60 minutes. Sample 1 was not pretreated for elemental sulfur removal, whereas, Samples 2 and 3 were both treated with hot toluene and rinsed with warm acetone prior to the iron carbonyl treatment. The comparative results are shown in Table 4.

TABLE 3

| Run Number | No Pretreatment | 1 | 2 | 3 | 4 | 5 | 6 | 7 |
|---|---|---|---|---|---|---|---|---|
| Conditions: | | | | | | | | |
| Gas | — | $N_2$ | CO $N_2$ | $CO_2$ $N_2$ | Air $N_2$ | $NH_3$ $N_2$ | $SO_2$ $N_2$ | Butane $N_2$ |
| Flow, ml/min | — | 150 | 50 100 | 27 123 | 150 150 | 50 100 | 50 100 | 50 100 |
| Time, min | — | 60 | 60 | 60 | 30 30 | 60 | 60 | 60 |
| Yield, Weight % | | | | | | | | |
| Clean coal | 56.9 | 69.6 | 77.4 | 72.3 | 73.9 | 89.8 | 61.3 | 61.8 |

TABLE 3-continued

| Run Number | No Pretreatment | 1 | 2 | 3 | 4 | 5 | 6 | 7 |
|---|---|---|---|---|---|---|---|---|
| Refuse | | 30.4 | 22.6 | 27.7 | 26.1 | 10.2 | 38.7 | 38.2 |
| Ash,% | | | | | | | | |
| Clean coal | 22.5 | 13.3 | 17.7 | 15.9 | 15.3 | 25.1 | 11.9 | 9.6 |
| Refuse | | 66.8 | 70.6 | 68.3 | 70.2 | 63.1 | 56.4 | 60.9 |
| Pyritic Sulfur,% | | | | | | | | |
| Clean coal | 1.85 | 0.40 | 0.52 | 0.47 | 0.42 | 1.00 | 0.57 | 0.31 |
| Refuse | | 4.17 | 4.48 | 4.22 | 4.13 | 7.15 | 2.95 | 3.24 |

The feed coal contained 29.9% ash and 1.63% pyritic sulfur.

Table 4

| Sample Number | S° (ppm) | Temperature of Carbonyl Treatment | Clean Coal Analysis Yield (Wt.%) | Ash (Wt.%) | Pyritic S, (Wt.%) |
|---|---|---|---|---|---|
| 1 | 105 | 190–195° C | 69.6 | 20.9 | 3.68 |
| 2 | <1 | 175–180° C | 74.2 | 15.2 | 3.04 |
| 3 | <1 | 190–195° C | 66.6 | 12.2 | 2.96 |
| Feed Analysis | | — | — | 25.5 | 3.91 |

EXAMPLE 5

Samples 1–12 presented in Table 5 of Lower Freeport Coal containing 156 parts per million elemental sulfur were pretreated with heat (including steam, where indicated), under the conditions given in Table 5. After the pretreatment each sample (75 grams) was treated with 16 kilograms per metric ton of iron pentacarbonyl at 170° C. for one hour with a nitrogen purge of 250 milliliters per minute during the heat up and cool down. Sample 13 was similarly treated with iron pentacarbonyl, but was not pretreated for the removal of elemental sulfur.

EXAMPLE 6

Lower Freeport coal sized to 14 × 0-mesh was treated for one hour with 16 kilograms per metric ton of iron pentacarbonyl at a temperature of about 170° C. Sample 1 was not pretreated for the removal of elemental sulfur, whereas, Samples 2 and 3 were treated at the conditions specified in Table 6 to remove a portion of elemental sulfur as indicated. The results are shown in Table 6, as is an analysis of the feed coal prior to any type of treatment.

TABLE 5

| Sample Number | Water, ml/min | Temp, ° C | Time, min | Steam Conc, %Atmos. | Elemental S,ppm | Yield, Wt % | Ash, % | Pyritic S, % |
|---|---|---|---|---|---|---|---|---|
| 1 | 0 | 190 | 10 | 0 | 9 | 54.5 | 11.2 | 1.13 |
| 2 | 0.95 | 190 | 10 | 25 | 8 | 52.6 | 13.1 | 1.45 |
| 3 | 3.35 | 190 | 10 | 89 | 7 | 55.8 | 10.6 | 0.84 |
| 4 | 0 | 260 | 10 | 0 | 3 | 71.4 | 13.5 | 1.23 |
| 5 | 0.95 | 260 | 10 | 28 | 5 | 69.7 | 13.9 | 1.02 |
| 6 | 3.35 | 260 | 10 | 98 | <1 | 81.2 | 18.7 | 0.84 |
| 7 | 0 | 190 | 30 | 0 | 2 | 73.9 | 15.7 | 0.59 |
| 8 | 0.95 | 190 | 30 | 25 | 2 | 68.3 | 12.0 | 0.53 |
| 9 | 3.35 | 190 | 30 | 89 | 2 | 68.1 | 11.5 | 0.37 |
| 10 | 0 | 260 | 30 | 0 | 3 | 65.6 | 18.6 | 1.27 |
| 11 | 0.95 | 260 | 30 | 28 | <1 | 75.3 | 14.8 | 0.77 |
| 12 | 3.35 | 260 | 30 | 98 | <1 | 78.6 | 16.4 | 0.58 |
| 13 | — | — | — | — | 156 | 56.9 | 22.5 | 1.85 |
| Raw Coal | — | — | — | — | 156 | — | 28.1 | 1.76 |

Table 6

| Sample Number | Pretreatment | S° (ppm) | Yield, Wt. % | Ash, % | Pyritic S, % |
|---|---|---|---|---|---|
| Feed | — | 242 | 100.0 | 28.1 | 1.76 |
| 1 | None | 242 | 56.9 | 22.5 | 1.85 |
| 2 | Heated in air at 137° C, 16 hours | 51 | 59.5 | 17.3 | 0.98 |
| 3 | Steam 19 kg/metric ton, $N_2$ 1700 ml/min at 130–140° C for 15 minutes | 160 | 78.1 | 21.5 | 1.58 |

EXAMPLE 7

A 75 gram sample of Illinois #6 coal, sized 14 × 150-mesh, was placed in a rotary reactor. 2.5 kilograms per metric ton of elemental sulfur was sublimed and allowed to react with the coal for 30 minutes at about 200° C. with no gas flow. A corresponding 75 gram sample received no pretreatment. Each sample was then treated with 7.5 kilograms per metric ton of iron pentacarbonyl at 190°–195° C. for 30 minutes. Table 7 provides the relevant feed coal and clean coal analyses for each sample.

Table 7

| Sample | Feed Analysis Ash, % | Pyritic S, % | Clean Coal Analysis Yield, Wt. % | Ash, % | Pyritic S, % |
|---|---|---|---|---|---|
| Sulfur Treated | 27.1 | 4.42 | 74.8 | 27.0 | 4.52 |
| No Pretreatment | 30.4 | 3.89 | 64.0 | 15.5 | 3.90 |

What is claimed is:

1. In a process for improving coal containing impurities and elemental sulfur wherein the coal is treated with a metal containing compound in order to enhance the magnetic susceptibility of one or more of the impurities susceptible to the metal containing compound treatment, thereby permitting the removal of these impurities by magnetic separation, the improvement comprising:

removing at least a portion of the elemental sulfur prior to performing the magnetic enhancement treatment.

2. The process of claim 1 wherein the means for removing elemental sulfur comprises heating the coal to at least a temperature for at least a period of time sufficient to essentially meet or exceed a time and temperature relationship expressed as:

$$D \geqq K\left(\frac{50}{T-90}\right)^3$$

wherein D is time in hours and T is temperature in degrees Celsius, and is not less than about 95° C., and wherein K is preferably at least about 0.5.

3. The process of claim 2 wherein K is preferably at least about 5.0.

4. The process of claim 2 wherein the coal is heated to a temperature of at least about 100° C. for at least about one hour.

5. The process of claim 2 wherein the heat pretreatment step is conducted in the presence of a member selected from the group consisting of nitrogen, steam, carbon monoxide, carbon dioxide, ammonia, methane, air, ethane, propane, butane, and other hydrocarbon compounds in the gaseous state at the pretreatment temperature.

6. The process of claim 1 wherein the means for removing elemental sulfur comprises pretreating the coal with steam.

7. The process of claim 6 wherein the steam pretreatment means is conducted within a temperature range of from about 100° C. to about 300° C. for at least about 0.25 hours with from about 2% to about 50% water based on the weight of the coal being treated.

8. The process of claim 1 wherein the means for removing elemental sulfur comprises solvent extraction.

9. The process of claim 8 wherein the solvent is selected from the group consisting of carbon tetrachloride, toluene, acetone, methyl alcohol, ethyl alcohol, ether, and liquid ammonia.

10. The process of claim 1 wherein the elemental sulfur concentration of the coal following the elemental sulfur removal step is less than about 200 parts per million.

11. The process of claim 1 wherein the elemental sulfur concentration of the coal following the elemental sulfur removal step is less than about 50 parts per million.

12. The process of claim 1 wherein the elemental sulfur concentration of the coal following the elemental sulfur removal step is less than about 10 parts per million.

13. The process of claim 1 wherein the impurities enhanced comprise a member selected from the group consisting of pyrite and ash-forming minerals.

14. The process of claim 13 wherein the impurities enhanced comprise pyrite.

15. The process of claim 13 wherein the impurities enhanced comprise ash forming minerals.

16. The process of claim 1 wherein the metal containing compound is a substantially undecomposed carbonyl selected from the group consisting of iron carbonyl, nickel carbonyl, cobalt carbonyl, molybdenum carbonyl, tungsten carbonyl, chromium carbonyl, and derivatives of these carbonyls.

17. The process of claim 16 wherein the metal containing compound consists essentially of iron carbonyl.

18. The process of claim 17 wherein the iron carbonyl consists essentially of iron pentacarbonyl.

19. The process of claim 1 wherein the metal containing compound is an iron compound.

20. The process of claim 19 wherein the iron compound is a member selected from the group consisting of ferrous chloride and ferric chloride.

21. The process of claim 19 wherein the iron compound is an organic iron containing compound.

22. The process of claim 21 wherein the organic iron containing compound is capable of exerting sufficient vapor pressure, with iron as a component in the vapor, so as to bring the iron into contact with the impurity at the reaction temperature.

23. The process of claim 22 wherein the vapor pressure of the organic iron containing compound is at least about 10 millimeters of mercury at the reaction temperature.

24. The process of claim 21 wherein said organic iron containing compound is selected from the group consisting of ferrocene, ferrocene derivatives, and $\beta$-diketone compounds of iron.

25. The process of claim 19 wherein the iron compound is selected from the group consisting of ferrocene, dimethyl ferrocenedioate, 1,1′-ferrocenedicarboxylic acid, ferric benzoylacetonate, ferric acetylacetonate, ferrous acetylacetonate, ferric octoate, $\alpha$-hydroxyethyl ferrocene, and ferrous formate.

26. The process of claim 19 wherein the iron compound is an ester of a ferrocene carboxylic acid derivative.

27. The process of claim 26 wherein the ester of a ferrocene carboxylic acid derivative is dimethyl ferrocenedioate.

28. The process of claim 19 wherein the iron compound is a simple iron salt of a monobasic or dibasic organic acid.

29. The process of claim 28 wherein the iron salt of a monobasic organic acid is iron formate.

30. The process of claim 19 wherein the iron compound is a $\beta$-diketone.

31. The process of claim 30 wherein the $\beta$-diketone iron compound is selected from the group consisting of ferric benzoylacetonate, ferric acetylacetonate and ferrous acetylacetonate.

32. The process of claim 19 wherein the iron compound is an iron salt of a carboxylic acid.

33. The process of claim 32 wherein the iron salt of a carboxylic acid is a ferric octoate.

34. The process of claim 19 wherein the iron compound is a hydroxyalkyl derivative of ferrocene.

35. The process of claim 34 wherein the hydroxyalkyl derivative of ferrocene is a $\alpha$-hydroxyethyl ferrocene.

36. A process for improving coal containing elemental sulfur and impurities comprising:

(a) subjecting the coal to a means for removing at least a portion of the elemental sulfur present;

(b) thereafter contacting the coal with iron carbonyl under reaction conditions such as to increase the magnetic susceptibility of one or more impurities contained within the coal;

thereby permitting the removal of the altered impurities by magnetic separation.

37. The process of claim 36 wherein the means for removing at least a portion of the elemental sulfur present in the coal comprises pretreating the coal by heating it to at least a temperature for at least a period of time sufficient to essentially meet or exceed a time and temperature relationship expressed as:

$$D \geqq K\left(\frac{50}{T-90}\right)^3$$

wherein D is time in hours and T is temperature in degrees Celsius, and not less than about 95° C., and wherein K is at least about 0.5.

38. The process of claim 37 wherein the coal is heated to a temperature of at least about 100° C. for at least about one hour.

39. The process of claim 37 wherein the coal is heated to a temperature of at least about 170° C. for at least about one hour.

40. The process of claim 36 wherein the means for removing at least a portion of the elemental sulfur contained within the coal comprises a steam pretreatment within a temperature range of from about 100° C. to about 300° C. for at least 0.25 hours with from about 2% to about 50% water based on the coal being treated.

41. The process of claim 36 wherein the means for removing at least a portion of the elemental sulfur contained within the coal comprises solvent extraction.

42. The process of claim 41 wherein the solvent is a member selected from the group consisting of carbon tetrachloride, toluene, acetone, ethyl alcohol, ether, and liquid ammonia.

43. The process of claim 41 wherein the solvent is a combination of hot toluene and warm acetone.

44. The process of claim 41 wherein the solvent is petroleum ether.

45. The process of claim 36 wherein the elemental sulfur concentration in the coal following the elemental removal step is less than about 200 parts per million.

46. The process of claim 36 wherein the elemental sulfur concentration in the coal following the elemental sulfur removal step is less than about 50 parts per million.

47. The process of claim 36 wherein the elemental sulfur concentration in the coal following the elemental sulfur removal step is less than about 10 parts per million.

48. The process of claim 36 wherein the impurities enhanced comprise pyrite.

49. The process of claim 36 wherein the impurities enhanced comprise ash forming minerals.

* * * * *